United States Patent [19]

Halssig

[11] 4,449,455

[45] May 22, 1984

[54] INERTIA FUSE WITH A SELF-DESTRUCT DEVICE FOR USE IN SPINNING PROJECTILES

[75] Inventor: Andreas Halssig, Schramberg, Fed. Rep. of Germany

[73] Assignee: Gebruder Junghans GmbH, Schramberg, Fed. Rep. of Germany

[21] Appl. No.: 374,712

[22] Filed: May 4, 1982

[30] Foreign Application Priority Data

May 15, 1981 [DE] Fed. Rep. of Germany ..... 3119369

[51] Int. Cl.[3] ..... F42C 15/26

[52] U.S. Cl. ..... 102/234; 102/246

[58] Field of Search ..... 102/234, 235, 236, 239, 102/243, 244, 246, 266, 267

[56] References Cited

U.S. PATENT DOCUMENTS 2,871,788 2/1959 Guerne ..... 102/267

3,995,557 12/1976 Engel et al. ..... 102/267

FOREIGN PATENT DOCUMENTS 2550093 5/1979 Fed. Rep. of Germany .

*Primary Examiner*—Charles T. Jordan

*Attorney, Agent, or Firm*—Burns, Doane, Swecker & Mathis

[57] ABSTRACT

An inertia fuse for use in spinning projectiles includes a firing pin and a spring for pushing the firing pin into a detonator. The spring force is isolated from the firing pin during flight by means of centrifugally-responsive bodies which are interposed between the spring and a sharp locking edge of a housing of the fuse. An inertia sleeve is slidable coaxially relative to the firing pin and has a beveled forward edge disposed behind the bodies and arranged to contact the bodies and wedge same inwardly away from the locking edge in response to impact, in order to release the spring sooner than would otherwise occur. The locking edge imposes minimal frictional forces against unlocking movement of the bodies.

10 Claims, 5 Drawing Figures

INERTIA FUSE WITH A SELF-DESTRUCT DEVICE FOR USE IN SPINNING PROJECTILES

BACKGROUND AND OBJECTS OF THE INVENTION

The invention concerns explosive projectiles and, in particular, relates to an inertia fuse with a self-destruct device for use in a spinning projectile.

An inertia fuse with a self-disintegrator device for use in a spinning projectile is known from DE-AS No. 25 50 093. The use is designed so that during impact ignition the greatest possible inertial mass is accelerating the firing pin. For this purpose, an inertia body is arranged behind a bushing designed as the firing pin to increase the response sensitivity of the projectile. Upon the impact of the projectile, the inertia body bears against the firing pin and increases, by means of its inertial capacity, the mass of the firing pin during the piercing of the primer cap. The forward motion of the firing pin is retarded by spherical centrifugal bodies of the self-destruct device. The centrifugal bodies are located in radial bores of the firing pin and are urged by the centrifugal effect of the spinning motion against a conical surface of the inner side of a guide sleeve. The specific surface load, and thus the friction between the spheres and the contact surfaces, is relatively high, whereby the response sensitivity is reduced.

Objects of the invention are to provide an inertia fuse with a self-destruct device for use in spinning projectiles that is safe against premature ignition and which has a minimal time delay and a great sensitivity upon impact on the target.

SUMMARY OF THE INVENTION

These objects are achieved in accordance with the present invention which relates to an inertia fuse for use in spinning projectiles. The fuse is of the self-destruct type having a detonator, an impact responsive firing pin arranged to ignite the detonator, and a detonator spring for urging the firing pin toward a detonating position. A plurality of centrifugally-responsive bodies are arranged in a locking position during spinning of the projectiles to resist spring-induced movement of the firing pin to its detonating position. An inertia member is provided for accelerating the occurrence of detonation in response to impact. The fuse includes a housing having a sharp edge. The centrifugal bodies, when in their locking position, are urged by the spring against the sharp edge of the housing, to prevent the spring from pushing the firing pin to its detonating position. The inertia member comprises a sleeve disposed behind the bodies and including an impact edge arranged to engage the bodies at impact locations disposed outwardly of those areas of the bodies against which the forces of the spring are applied when the bodies are in their locking position. In this manner, the bodies are displaced inwardly and out of engagement with the edge to release the spring in response to impact. A safety dvice opposes movement of the inertia member to prevent premature release of the spring.

According to the invention, the piercing action of the firing pin is accelerated in a simple manner in that, upon the impact of the projectile against the target, the inertia member acts directly on the centrifugal bodies normally retaining the firing pin in the inactive position. The conditions of friction during the pressuring away of the centrifugal bodies through the locking edge are highly favorable (i.e., little generation of friction) by virtue of the small abutting surfaces between the centrifugal bodies and the blade-like locking edge (knife-edge bearing) and thus promotes a rapid acceleration of the piercing action of the firing pin. The firing pin has the configuration of a concussion piece or hammer. The points of impact of the inertia member against the centrifugal bodies ae located so that a relatively small stroke of the inertia member suffices to eject the centrifugal bodies from their locking position. The self-destruction function of the fuse is thus assured.

Preferably, the sharp edge is of circular configuration, with the impact locations lying on a circle, the diameter of which is larger than that of the sharp edge. It will be appreciated that the unlocking forces exerted by the inertia member against the centrifugal bodies occurs generally in the unlocking direction of the centrifugal bodies, thereby rendering the resisting forces by the locking edge to be relatively weak. This tends to further accelerate the piercing action of the firing pin. Preferably, the safety device comprises a biasing spring and/or a shear pin. As a result, the fuse is rendered safe against inadvertent ignition occurring from impact against rain drops or leaves, etc. In the event that a helical compression spring is employed as the safety device, the spring characteristics thereof are selected so that under the influence of retardation after the projectile leaves the barrel, the inertia member hardly moves at all. Preferably, the beveled edge of the inertia member is maintained in spaced relationship from the bodies by the safety device as further assurance against premature firing.

The centrifugal bodies may be of various configurations, such as spheres or cylindrical rollers having conical ends. It will be appreciated that if the centrifugal bodies are of the roller type with curvilinear outer peripheries, the resulting contact area of such a curvilinear periphery with a sharp locking edge is minimal, thereby minimizing frictional forces tending to oppose the unlocking travel of the centrifugal bodies.

THE DRAWING

Preferred embodiments of the invention are shown in the drawing, wherein:

FIG. 1 is a longitudinal sectional view through an inertia fuse for spinning projectiles in the safe position;

FIG. 2 depicts the fuse of FIG. 1 after the completion of the projectile acceleration phase, FIG. 2*a* is a view similar to FIG. 2 after the inertia body 12 has been displaced into contact with the spheres 5 in the process of camming those spheres inwardly, FIG. 3 is a partial cross-sectional view taken along line III—III in FIG. 1, and FIG. 4 depicts a variant of the spherical centrifugal bodies according to FIG. 3.

DETAILED DESCRIPTION OF PREFERRED EMBODIMENTS OF THE INVENTION

Figure 1:
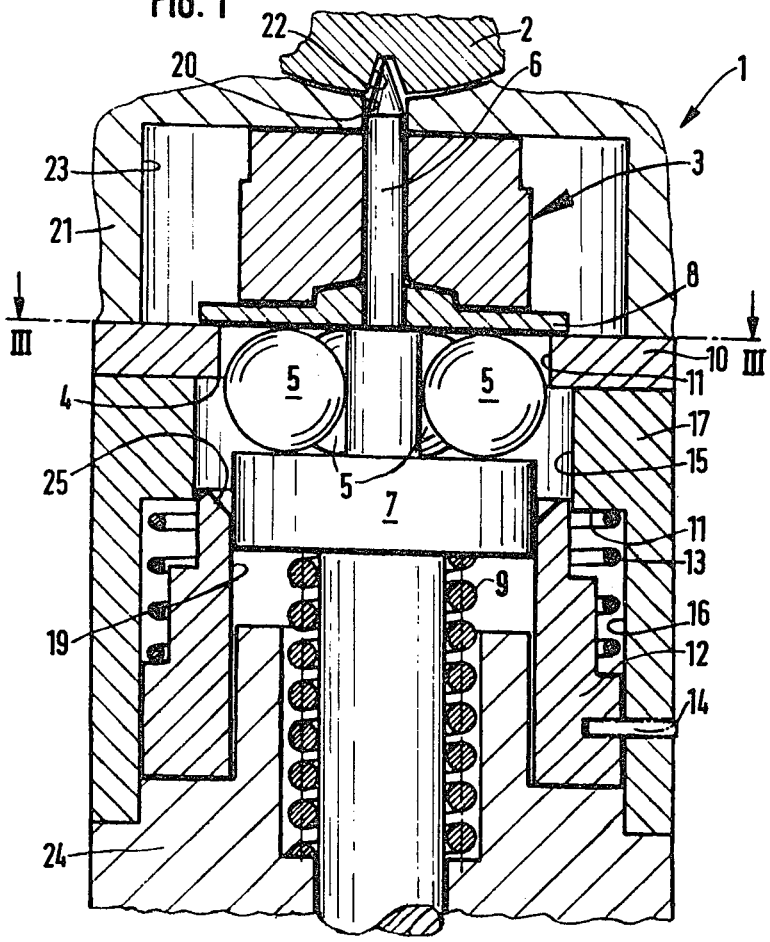

An inertia fuse 1 according to the present invention is depicted in FIG. 1 in its safety position within a projectile. The fuse 1 includes a rotor 2, a conventional spin-responsive device 3 for prefiring safety, and a self-destruct device.

The latter comprises a blade-like locking edge 4 and a plurality of centrifugal bodies in the shape of spheres 5. A firing pin 6 sits upon a reciprocable collar 7 and projects through a plate 8. A disintegrator spring 9 comprises a yieldable coil compression spring which acts to bias the collar 7 toward the rotor 2. An actuating device is provided to increase the sensitivity of the detonation process.

The actuating device comprises an axially displaceable inertia member or body in the shape of a sleeve 12 surrounding the collar 7. A coil compression spring 13 is arranged to oppose movement of the sleeve 12 toward the spheres 5. A safety shear pin 14 may be used with or in lieu of the spring 13 for releasably retaining the sleeve 12. The inertia body is axially displaceable in bores 15, 16 of a housing portion 17.

The sharp locking edge 4 comprises a portion of a bore defining wall 11 of a plate 10, the latter being fixedly mounted to the housing.

The firing pin 6 and collar 7 are displaceable as a unit, the former being slidable within a bore 20 of a part 21 fixed to the housing and the collar 7 being slidable within a bore 19 of the inertia body 12. Prior to firing, the firing pin projects into a recess 22 of the rotor 2 and retains the latter in a safety position.

Figure 2:
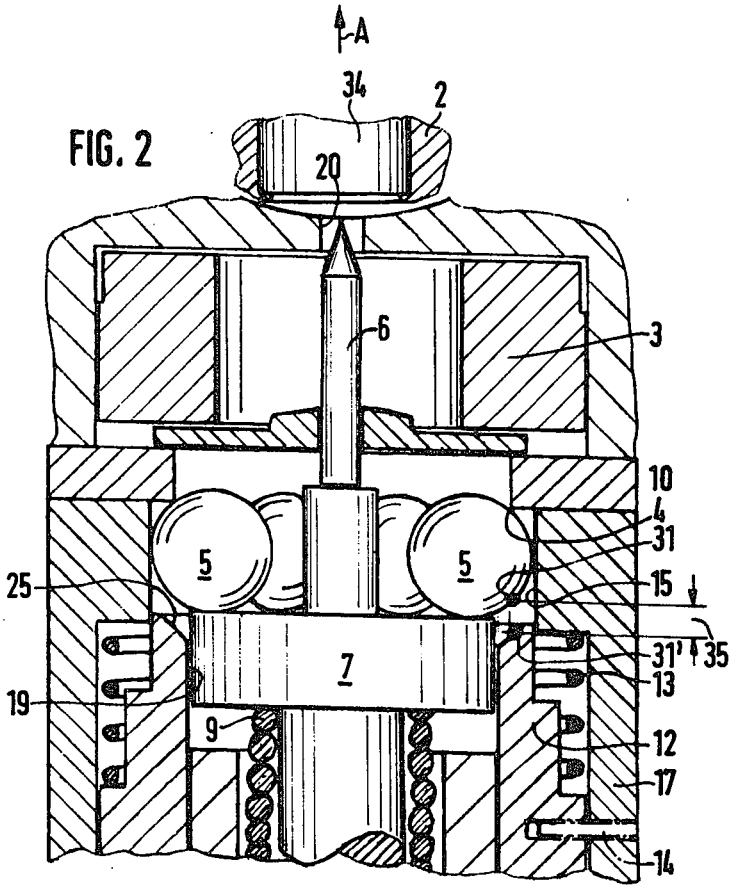

The part 21 includes an enlarged bore 23 for receiving the pieces of the spin-responsive device 3 as depicted in FIG. 2. The spring 9 is disposed within a spring casing 24 which projects into the sleeve 12 with radial clearance therebetween.

Figure 2A:
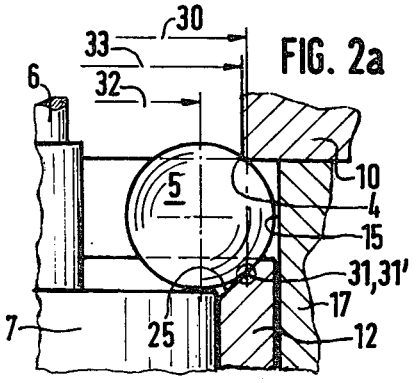

The inertia body 12 includes a beveled impact edge in the form of a frusto-conical surface 25, which surface faces toward the spheres 5. The inertia body 12 is adapted to contact the spheres 5, making contact therewith at impact points 31 on the surface 25 (FIG. 2*a*). Those impact points 31 are situated on a circle (coaxial with the firing pin 6), the diameter 30 of which is larger than the diameter 32 of a circle on which the centers of the spheres 5 lie when the spheres 5 are in an outwardly urged position in abutment with the bore 15. The diameter 30 is slightly larger than the diameter 33 of the blade-like locking edge 4. Thus, the impact areas 31 are situated outwardly of the areas where the forces of spring 9 act against the spheres 5.

As depicted in FIG. 2, the acceleration of the fired projectile causes the disintegrator spring 9 to be depressed under the urgings of the rearwardly-urged collar 7, thereby allowing the spheres 5 to travel behind the locking edge 4 under the action of spin-induced centrifugal force. Accordingly, when the acceleration is finished, the collar 7 and spring 9 are locked in a cocked condition. The rotor 2 has thus been released for travel to its firing position wherein a detonator becomes aligned with the firing pin 6.

If the fuse cap (not shown) of the projectile impacts against rain drops, insects, leaves, etc., the inertia body 12 may be displaced within a distance 35 (FIG. 2), in keeping with the strength of the spring 13. If the shear pin 14 is used in place of the spring 13, it is arranged so as to permit such movement 35 only.

The inertia body 12 has a greater mass than the firing pin 6. Therefore, when the projectile impacts against a target, the inertia body 12 is rapidly projected forwardly against the force of the spring 13 and into contact with the spheres 5. The beveled edge 25 wedges or cams the latter inwardly from their locking positions sooner than they would otherwise be displaced. This occurs prior to or simultaneously with the advancement of the firing pin. The unrestrained pin travels forwardly into ignition-causing contact with the detonator 34.

It will be appreciated that the unlocking and firing of the firing pin occurs with only minimal frictional forces being generated in the bores 19 and 20.

Lateral sensitivity of the fuse can be provided to the required extent. In the event of a lateral impact of the fuse against a target, the inertia body 12 is caused to slide forwardly against the force of the spring 13 to eject the spheres 5 from their locking positions. Thus, the spring 9 is released to advance the firing pin in the direction of arrow A to ignite the detonator 34.

The spring 9 assures that the detonator will be pierced even in the event of a relatively weak impacting of the fuse.

It will be appreciated that below a given rotational or spin speed, the pressurized spring 9 overcomes the locking action of the spheres 5 and pushes the firing pin into the detonator, thereby effecting a self-destruction of the projectile.

Figure 3:
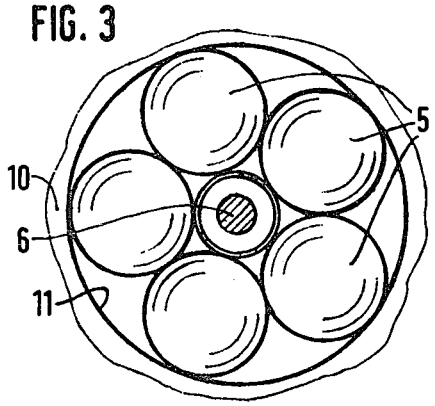
Figure 4:
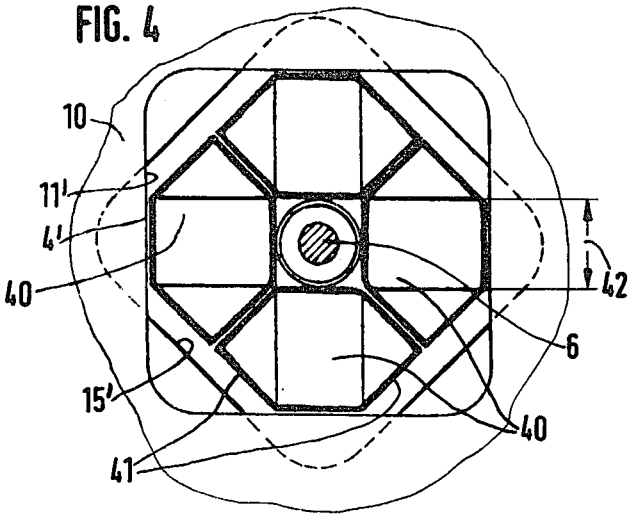

In lieu of the spheres 5 depicted in FIGS. 1–3, other types of centrifugal bodies can be employed. For example, there can be provided a plurality of rollers 40 having conically-shaped ends 41 (FIG. 4). To receive the rollers 40 in the plate 10 and in the part 17, square recesses 11' and 15' are provided which are mutually offset by 45 degrees. When the rollers are in the locking position (corresponding to FIG. 2), the cylindrical portion 42 of the rollers 40 enter an associated corner of the recess 15' and abut against a sharp locking edge 4' defined by a portion of the recess 11'. As a result, the forces imposed upon the edge 4' are distributed along the edge 4', i.e., are less concentrated than those imposed by the spheres 5 against the edge 4.

It will be appreciated that there occurs very little frictional force opposing movement of the bodies 5 or 40 to their unlocking positions, due to the minimal contact area between the sharp edge 4 and the bodies. This feature, together with the action of the inertia sleeve in effecting a rapid release of the spring, achieve a relatively high ignition sensitivity.

Although the present invention has been described in connection with preferred embodiments thereof, it will be appreciated that those skilled in the art that additions, substitutions, deletions and modifications may be made without departing from the spiriting and scope of the invention as defined in the appended claims.

I claim:

1. An inertia fuse for spinning projectiles, said fuse being of the self-destruct type having a detonator, an impact responsive firing pin arranged to ignite the detonator, a detonator spring for urging the firing pin toward a detonating position, and a plurality of centrifugally-responsive bodies arranged in a locking position during spinning of the projectile to resist spring-induced movement of the firing pin to its detonating position, and an inertia member for accelerating the occurrence of detonation in response to impact, the improvement wherein:

said fuse includes a housing having sharp edge means, said centrifugal bodies, in said locking position, are urged by said spring against said sharp edge means of said housing, to prevent said spring from pushing said firing pin to a detonating position, said inertia member comprises a sleeve disposed behind said bodies and including impact edge means arranged to engage said bodies at impact locations disposed outwardly of those areas of the bodies against which the forces of the spring are applied when said bodies are in said locking position, to displace said bodies inwardly and out of engagement with said sharp edge means to release said spring in response to impact, and safety means for opposing movement of said inertia member to prevent premature release of said spring.

2. Inertia fuse according to claim 1, wherein said sharp edge means is of circular configuration, said impact locations lying on a circle the diameter of which is larger than that of said sharp edge means.

3. Inertia fuse according to claim 1, wherein said safety means comprises a shear pin engaging said housing and said inertia member.

4. Inertia fuse according to claim 1, wherein said safety means comprises a yieldable biasing element.

5. Inertia fuse according to claim 1, wherein said impact edge means of said inertia member is maintained in spaced relationship from said bodies by said safety means.

6. Inertia fuse according to claim 1, wherein said bodies comprise spheres, and said sharp edge means is of circular configuration.

7. Inertia fuse according to claim 1, wherein said bodies comprise cylindrical rollers having conical ends, said sharp edge means being of square configuration.

8. Inertia fuse according to claim 1, wherein said impact edge means is beveled to cam said bodies inwardly.

9. An inertia fuse for spinning projectiles, said fuse comprising:

a housing, a detonator, a firing pin alignable with said detonator, a spring for pushing said firing pin into said detonator, a plurality of centrifugally responsive rolling bodies interposed between said firing pin and said spring and being outwardly movable in response to centrifugal force to locking positions behind a sharp locking edge of said housing to resist the forces of said spring and isolate same from said firing pin until impact occurs, an inertia sleeve movable coaxially relative to said firing pin and including forward edge means disposed behind said bodies and arranged to engage said bodies and wedge same inwardly and away from said locking edge in response to impact to release said spring, and means opposing forward movement of said inertia sleeve to prevent premature release of said spring.

10. Inertia fuse according to claim 9, wherein said forward edge means of said inertia sleeve is beveled.

* * * * *